United States Patent [19]

Putterlik

[11] 4,078,718

[45] Mar. 14, 1978

[54] APPARATUS AND METHOD FOR AUTOMATICALLY DISCHARGING A THICKENED FRACTION FROM A CENTRIFUGE ROTOR

[75] Inventor: Jan Putterlik, Prague, Czechoslovakia

[73] Assignee: Ceskoslovenska akademie ved, Prague, Czechoslovakia

[21] Appl. No.: 765,631

[22] Filed: Feb. 4, 1977

[30] Foreign Application Priority Data

Feb. 12, 1976 Czechoslovakia ..... 920/76

[51] Int. Cl.[2] ..... B04B 1/14

[52] U.S. Cl. ..... 233/20 R

[58] Field of Search ..... 233/20 R, 20 A, 19 R, 233/19 A, 46, 47 R; 210/110, 111, 112, 113, 104

[56] References Cited

U.S. PATENT DOCUMENTS

| | | | |
|---|---|---|---|
| 2,488,746 | 11/1949 | Strezynski | 233/20 R |
| 3,114,655 | 12/1963 | Jiskra | 233/20 R |
| 3,341,093 | 9/1967 | Putterlik | 233/20 R |
| 3,749,304 | 7/1973 | Putterlik | 233/47 R |

*Primary Examiner*—George H. Krizmanich
*Attorney, Agent, or Firm*—Burgess, Ryan and Wayne

[57] ABSTRACT

Discharge nozzles for the automatic discharge of a thickened fraction from a centrifuge rotor controlled by elastically yielding bodies in dependence on a raising and lowering of the level of the thickened fraction in the centrifuge rotor, are intermittently opened by means controlling the throughflow resistance of the cleared fraction discharged from the contrifuge rotor.

5 Claims, 3 Drawing Figures

APPARATUS AND METHOD FOR AUTOMATICALLY DISCHARGING A THICKENED FRACTION FROM A CENTRIFUGE ROTOR

BACKGROUND OF THE INVENTION

The invention relates an apparatus and method for automatic discharging a thickened fraction from a centrifuge rotor. The arrangement according to this invention, is particularly suitable for but not limited to thickening of suspensions, where the specific mass of the thickened fraction thereof does not substantially differ from the specific mass of the starting suspension.

In the specification of U.S. Pat. No. 3,749,304 of the inventor herein, an automatic control arrangement for discharging a thickened fraction from a centrifuge rotor is described, based on the elastic deformation of elastically yielding bodies through which valve rods pass, opening and closing discharge valves on the circumference of the centrifuge rotor. These elastically yielding bodies are within a zone radial limit between an upper and lower level of the thickened fraction and as their deformation depends on the distribution of the hydrostatic pressure in their vicinity, these deformations can be utilized for the control of the position of valve rods with respect to discharge nozzles.

This prior art arrangement This arrangement operates as follows: so far as the level of the thickened fraction does not reach the elastically yielding body, the discharge nozzle remains closed by the valve rod. If however the level of the collected thickened fraction raises centripetally and starts to surround the elastically yielding body, the thickened fraction starts to act on this body due to its higher specific mass than the treated suspension by an increased pressure and to deform this body by pressure perpendicularly to the valve rod, lenghtening this body in direction towards the axis of the rotor. These deformations are transmitted by means of a strap plate to the valve rod, causing an opening of the discharge nozzle. If due to the opened discharge nozzle the level of the thickened fraction in the centrifuge rotor has dropped, the increased pressure on the elastically yielding body ceases, the body returns to its original state and the valve rod again closes the discharge nozzle. These described operations have a quick sequence, i.e. a relatively quick change of the closed to the opened position and vice versa takes place, as the movement of the valve rod is supported by the increase of the hydrostatic pressure acting on the face of the valve rod in the course of opening, and by a decrease of this pressure in the course of closing the nozzle.

The described arrangement operates satisfactorily for separating most suspensions, if, however, suspensions with a small difference of the specific mass of the thickened fraction with respect to the specific mass of the starting suspension have to be separated (for instance biological sludges, yeast dispersions and similar), the valve rods are actuated only if a substantial difference of the radial distance between the upper and lower level of the thickened suspension is reached. In the course of discharge of the thickened fraction and decrease of its level to the lower level, the thinner fraction are taken along, thus reducing the concentration of the resulting product.

SUMMARY OF THE INVENTION

It is an object of this invention to eliminate or at least to mitigate this drawback and to provide an arrangement, where a sufficient amount of the thickened fraction would be maintained, preventing thus any taking along of thinner fractions in the course of opening the nozzles. The required small radial distance between the lower and upper level of the thickened fraction is achieved by allowing the elastically yielding bodies to operate independently solely when closing the discharge nozzles, whereas their operation when opening is aided by periodic action of pressure differences on parts of their surface, described in the following.

According to this invention the front wall of the elastically yielding body facing the rotor axis is exposed to a constant hydrostatic pressure, independent of the hydrostatic pressure of the suspension or of the thickened fraction, surrounding the remaining part of the surface of this body. The pressure of this suspension or of the thickened fraction in the rotor is periodically increased due to an increase of the level of the suspension in the rotor. This increase of the level in the rotor is advantageously achieved by periodic pressure increase in the discharge of the thinned fraction.

In the arrangement according to this invention, the front walls of the elastically yielding bodies facing the rotor axis are provided with elastic collars, drawn over edges of chambers on the circumference of a disc shaped regulating body, situated in the plane of symmetry of the centrifuge rotor between blocs of separator plates. A space is formed in the central part of this regulating body, connected with individual chambers by channels, which space is together with said channels and chambers partly filled by a liquid. Some means for increasing the throughflow resistance is introduced into the discharge of the thinned fraction from the centrifuge rotor. The front walls of the space in the central part of the regulating body are advantageously closed by diaphragms for equalizing the pressure. The control inlet of means for increasing the throughflow resistance can be connected to the outlet of the source of control pulses.

The advantages of the method and of the arrangement according to this invention are that even in case of small differences of specific masses between the thickened fraction and the starting suspension no thinner fractions are taken along from the centrifuge rotor by the discharged thickened fraction.

It is particularly advantageous, that the reinforcing of the operation of the elastically yielding bodies can be also utilized for cleaning the centrifuge, what has to be particularly performed when ending the operation. It is advantageous that for cleaning, it is sufficient to supply to the centrifuge water or some other cleaning medium and cease the operation after a predetermined operating time after closing the discharge of the cleared fraction. The solution of the regulating system, i.e. of the regulating bloc, comprising the hydromechanism of all discharge nozzles offers a simple manipulation when assembling and disassembling the machine. The watertight connection of the mobile parts by elastic collars and the provision of diaphragms for equalizing the pressure are thereby particularly advantageous.

Another advantage of the construction of the centrifuge according to this invention are grooves on the circumference of the regulating body and on the circumference of separator discs, where these discs are axially supported on radial vanes inside the rotor. An internal grooved shaft, common for all centrifuges with discs is thus not required, so that the construction becomes simple and the internal space of the rotor is better utilized for the technological process.

DESCRIPTION OF PREFERRED EMBODIMENT

Figure 1:
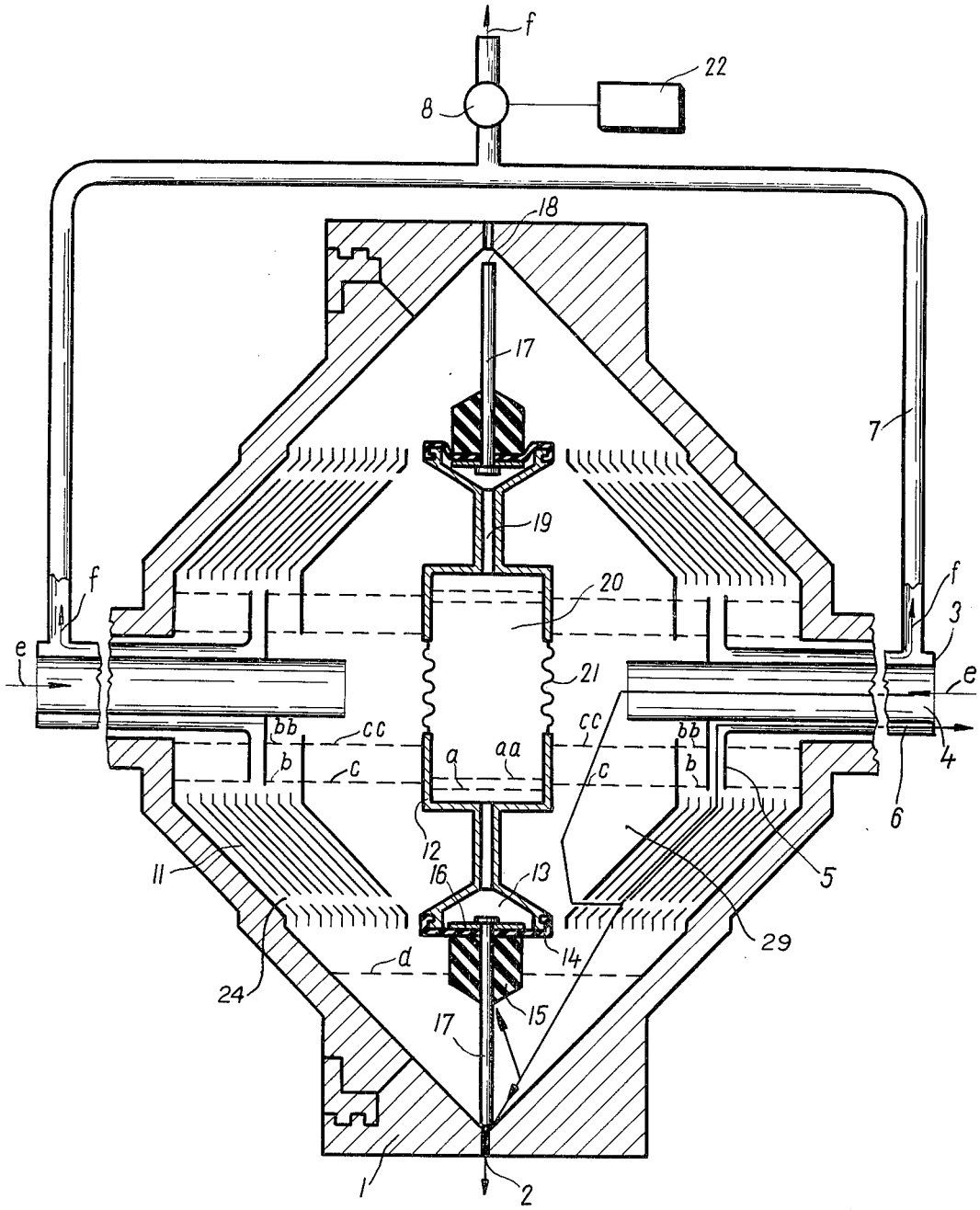
FIG. 1 shows a longitudinal view of a centrifuge according to a preferred embodiment of the invention.

FIG. 1 shows a rotor 1 provided on its circumferential mantle with discharge nozzles 2 for discharge of the thickened fraction. A stable tubular body 3 with a channel 4 for supplying the suspension to be centrifuged, and with a collector 5 and a channel 6 for discharge of the cleared fraction is from both sides inserted into the rotor 1. Restrictive means 8 for increasing the throughflow resistance is provided in the discharge path of the cleared fraction. The control inlet of restrictive means 8 is connected to a source 22 of control pulses . Radial vanes (See FIG. 2) 9 are situated inside the rotor 1, on which vanes 9 both blocs of separator discs 11 and a regulating body 12 are inserted by means of their grooves 10. Chambers 13 are provided on the circumference of the regulating body 12. An elastic collar 14 comprises an outside wall of each chamber 13, to which collar 14 an elastically yielding body 15 is connected. An equalizing disc 16 with a suspended valve rod 17 passing through the body 15 forming a water-tight seal therewith and terminating in a valve 18 is provided in the chamber 13. The chambers 13 are interconnected by channels 19 with the central chamber 20, the front parts of which chamber 20 are closed by diaphragms 21 for equalizing the pressure. On both front faces of the regulating body 12 there is a distributor space 29 provided with radial vanes 23. The holes 24 in the separating discs 11 represent passages in both disc blocks. The means 8 for increasing the throughflow resistance can be valve, a revolving flap, a slide valve and the like. The rotor 1 is supported by bearings 25 and driven by pulleys 26. On the circumference of the rotor 1 there is a ring collector 27 for preventing the thickened fraction from splashing into the surrounding area. The outer circumference of said ring 27 carries teeth for engagement with a drive 28 for rotating the ring collector 27 slowly around the centrifuge 1.

The described arrangement operates as follows:

In operation, the content of liquid in the rotor 1 achieves a certain radial height specified as follows: the level *a* and the raised level *aa* of the liquid content in the regulating body 12, the level *b* of the cleared fraction and the raised level *bb* of the cleared fraction, the level *c* of the supply of the suspension, the raised level *cc* of the supply of the suspension, the level *d* of the lower state of the thickened suspension.

The direction of flow is specified: the supply into the rotor 1 of the centrifuge by the arrow *e*, the direction of removal of the cleared fraction from the centrifuge by the arrow *f*, the direction the thickened fraction is discharged from the centrifuge by the arrow *g*, and the raking of the thickened fraction from the ring collector 27 by arrow *h*.

A liquid is disposed inside the regulating body 12, its volume being determined so that in operation the level thereof achieves in the chamber 20 a radial height indicated for instance by the level *a*. At a certain resistance of the removed cleared fraction in the discharge tube 7 and further beyond the centrifuge, the cleared fraction in the centrifuge achieves for immersion of the collector 5 a radial height indicated for instance by the level *b*. The suspension in the supply equally achieves a certain radial height equivalent to the pressure drop for passage through the centrifuge, indicated for instance by the level *c*.

By the liquid content of the regulating body 12 and by the masses of the balancing disc 16 of the elastically yielding body 15 and of the valve rod 17, the regulating system is adjusted for a closing of the discharge nozzle 2 if the level of the thickened mass drops to the lower allowable limit, that is, if the drop of the level drops below that of the body 15, for instance indicated by the level *d*.

The suspension enters the centrifuge rotor 1 in direction of the arrow *e* via the channel 4 and continues into the distributor space 29. After being rotated by the radial vanes 23 the suspension enters the gaps between the collecting discs 11 through holes 24. The suspension flows further as commonly known through the rotor 1 and in many narrow gaps between separating discs 11 it is separated to a cleared fraction and to a thickened fraction. The cleared fraction flows centripetally, is collected by the collector 5 and is discharged over channel 6 and means 8 for increasing the throughflow resistance beyond the centrifuge.

The thickened fraction is passing centrifugally into the space around the blocs of separating discs 11 where it settles, forms a thickened mass with a centripetally increasing level and surrounds the body 15.

Figure 2:
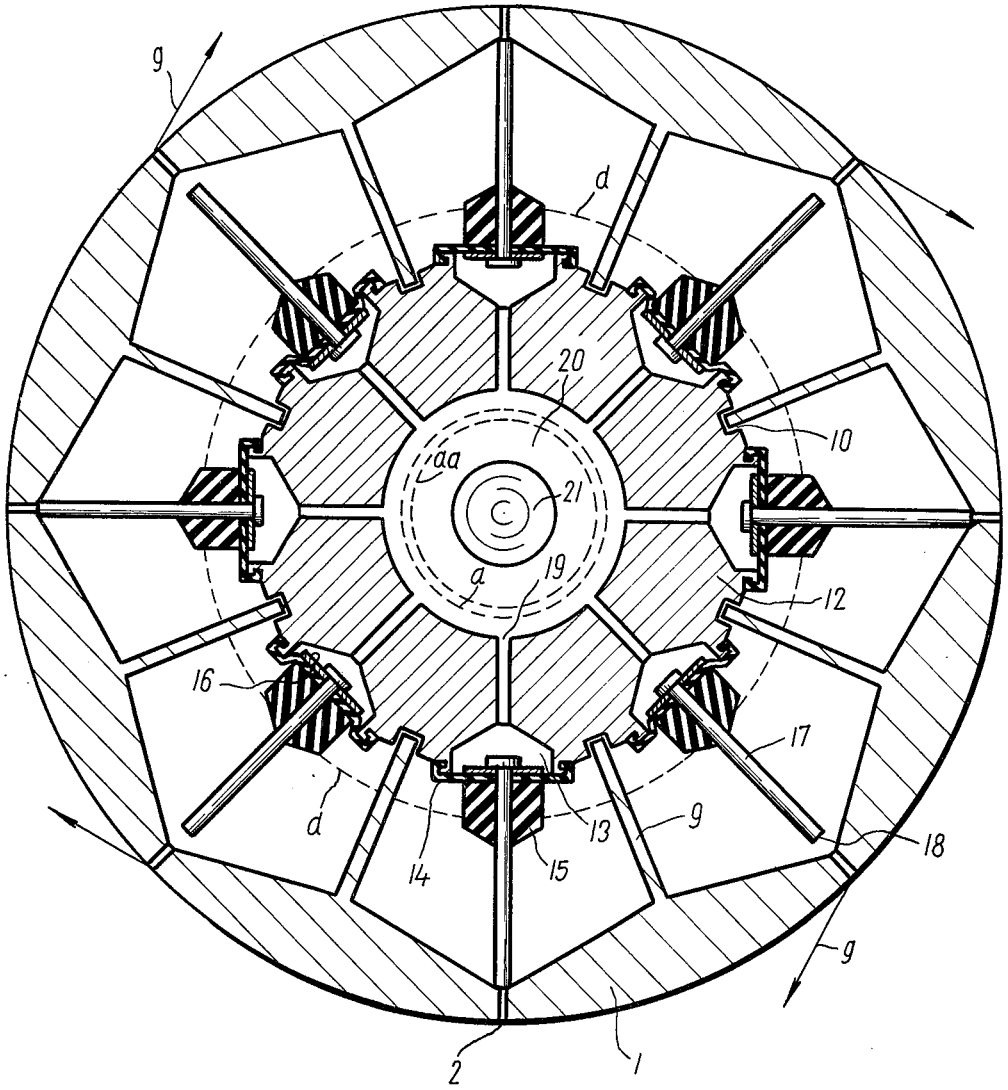
FIG. 2 is a cross sectional view of the rotor of the centrifuge of FIG. 1, the lower half of said view being taken through the discharging nozzles and the symmetry plane of the regulating body, the upper left quarter being taken in a gap between separating discs of the rotor and through the collector, and the upper right quarter being taken through the distributor space of the rotor.
Figure 3:
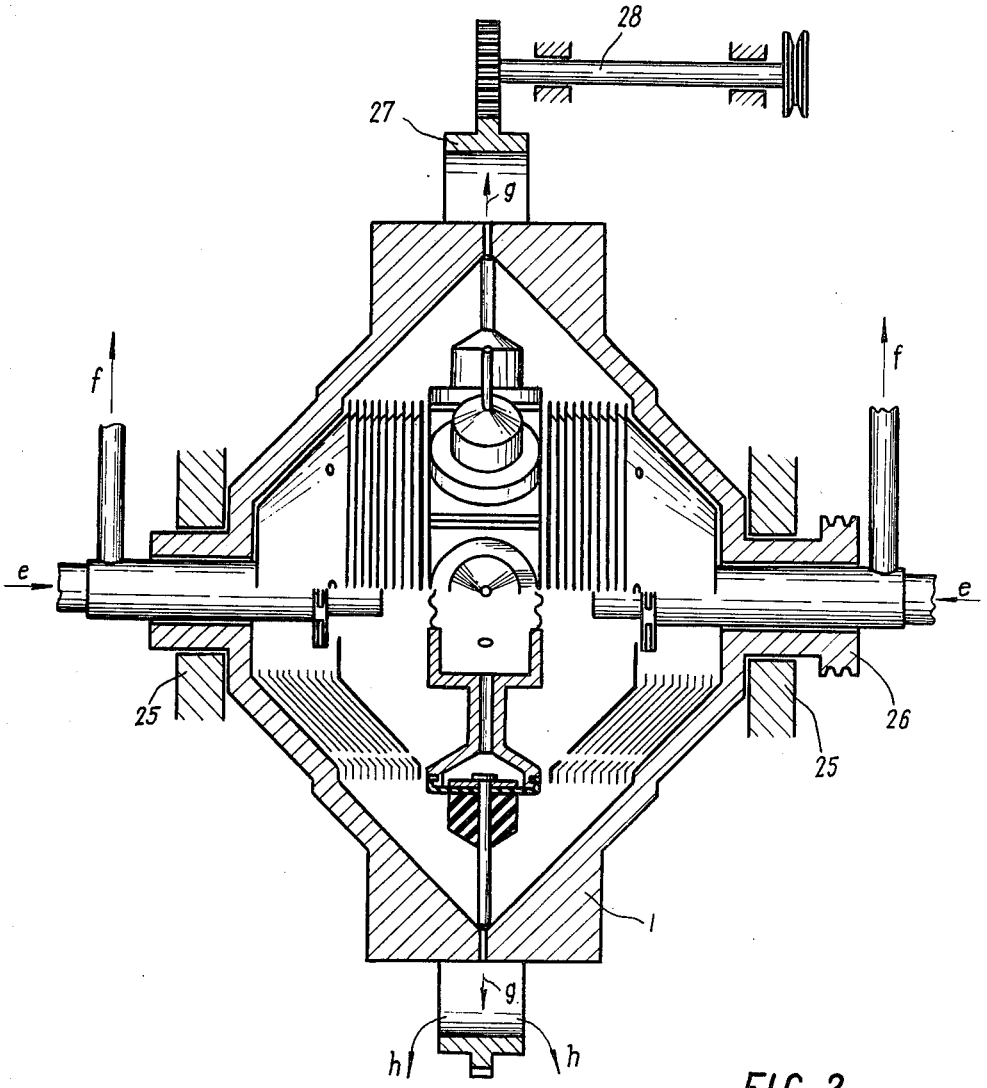
FIG. 3 is another sectional view of the centrifuge of FIG. 1 showing the bearing means and the driving means therefor.
Figure 2:
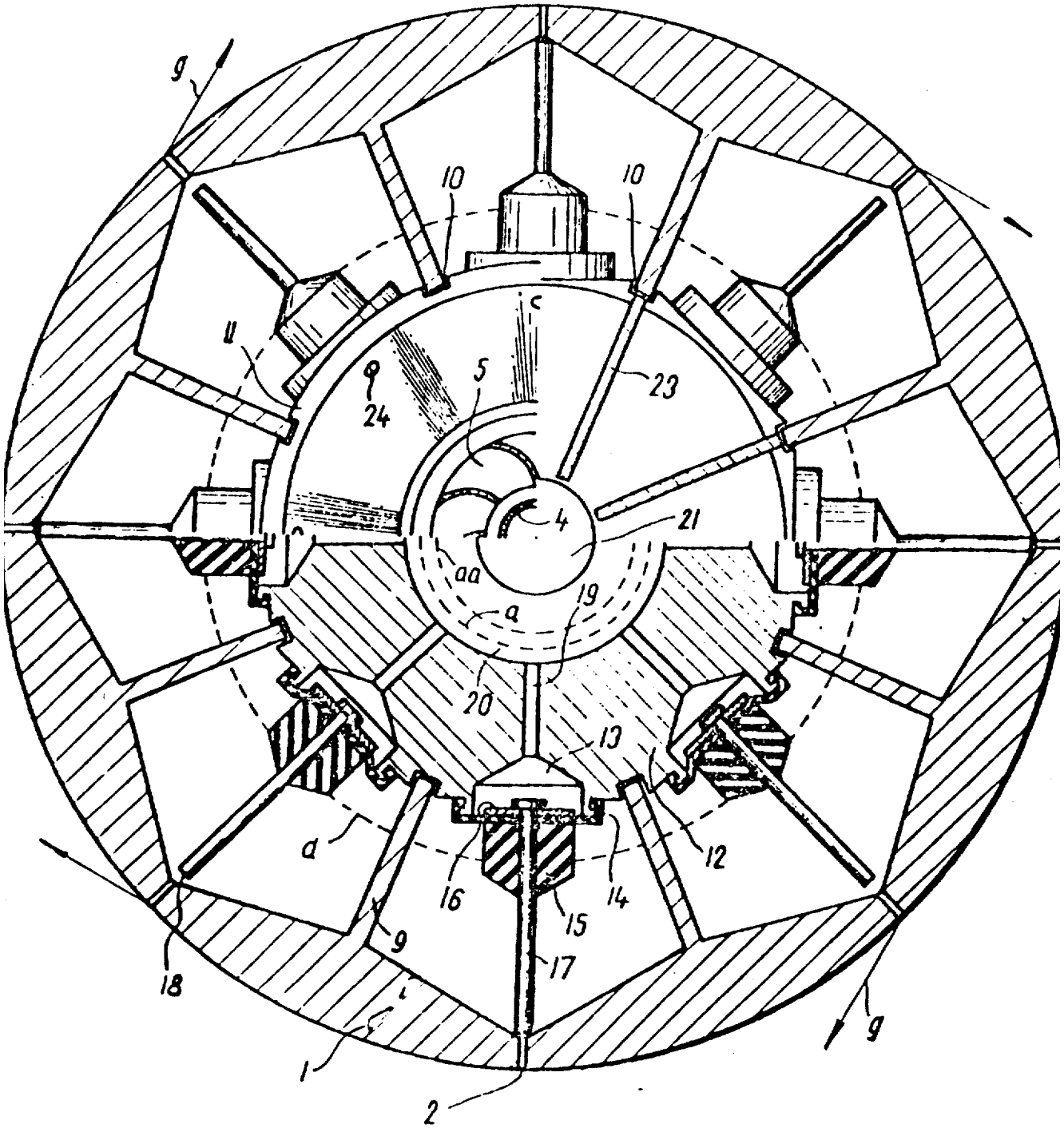

In contradistinction to prior art techniques, the opening of discharge nozzles 2 is not derived solely from the achievement of the upper limit of the level of the thickened fraction, but at certain intervals an increase of the hydrostatic action or deformation respectively of the body 15 is automatically introduced, causing the simultaneous opening of all nozzles 2. This increase lasts, however, only a short time so that during the following moment only the hydrostatic pressure in the rotor 1 acts on the body 15, for which pressure the regulating system is adjusted. Therefore if separation of the thickened fraction its level drops to the lower allowable limit, the respective discharge nozzle 2 is closed. This action proceeds already independently on the external control of the hydrostatic pressure in the rotor 1. In FIG. 1 this closing is indicated for the lower discharge nozzle 2, whereas the upper discharge nozzle 2 remains opened. In FIG. 2 an example of already closed and still opened nozzles 2 is shown alternately. In the drawing can be also seen the elastic deformation of the elastic collar 14 in case of a centripetal hydrostatic action. The periodic increase of the hydrostatic action of the body 15 is obtained by a short-time closing or partial closing of the means 8 for increasing the throughflow resistance. Thus a periodic interruption or slowing down of the removal of the cleared fraction from the rotor 1 is achieved, which causes in case of a constant rate of supply of the suspension into the rotor 1 of the centrifuge, a short-time raising of the level *b* of the cleared fraction and of the level *c* of the supply of the suspension to levels *bb* and *cc* respectively. This radial raising of the level of the cleared fraction causes an increase of the hydrostatic pressure in the rotor 1 and the already described increase of the hydrostatic action or of the deformation of the body 15 respectively.

At a simultaneous opening of all discharge nozzles 2, the level *a* raises to the higher level *aa* of the liquid content of the regulating body 12 and the elastic collars 14 are pushed back into the chambers 13 due to the centripetal motion or due to the deformation of bodies 15. This raising of the level *a* to the higher level *aa* is however negligible with respect to the raising of levels *b* and *e* to *bb* and *ee*, so that the increase of the hydrostatic action of bodies 15 is thereby not affected. The periodic short time closing of means 8 for increasing the throughflow resistance can be accomplished by a source 22 of control pulses, which can be adjusted to the closing time and to time between closing and opening of means 8 for increasing the throughflow resistance.

Any liquid used in liquid regulators may be used in the regulating body 12. Before starting the centrifuge the regulating body 12 is filled with a quantity of such liquid determined by taking into consideration the weight of elements 15, 16 and 17 in conjunction with the hydrostatic pressure of the thickened fraction and the level *d* at which the mass of liquid and the elements 15, 16 and 17 overcome the hydrostatic pressure and the valve rod 17 closes the valve 2.

Before starting the operation of the centrifuge, the regulating system elements 12 to 21 should be adjusted according to the technological and physical properties of the suspension to be separated, i.e., specific gravity of the clarified and thickened fractions obtained by separation of the suspension.

Adjustment of the regulating system is accomplished by the choice of equalizing discs 16, available in sets of different mass. The volume of the regulating liquid in the regulating body 12 is chosen so as to reach the required level *a* (radial height *a* during the operation).

The centrifuge is started at a low rotational speed which, however, must be high enough to keep the centrifugal acceleration inside the rotor 1 slightly above the rate of gravitational acceleration, i.e., to keep the incoming liquid (suspension) and the regulating liquid from overfalling (falling down) in the horizontally revolving rotor 1 and to force the liquids to form a cylindrical level specified e.g., as level *a, b, c*. This can be easily achieved with a rotor speed of 100–150 r.p.m.

As soon as the rotor 1 is filled with suspension (or with plain water for initial operation), i.e., as soon as the suspension starts to discharge (discharge 7) or to overflow alongside the tubular body 3, the centrifuge is ready to be driven up to the full operational speed of the rotor 1.

At full operational speed, the centrifugal acceleration inside the rotor 1 reaches a value on the order of 1000 times the gravitational acceleration, so that the influence of gravity on the operation of the rotor 1 with the axis of rotation (horizontal) is negligible.

A detailed description has already been given of the function of the centrifuge during the discharge of the thickened fraction by opening and closing of the discharge nozzles 2. The main feature of this discharging operation is the fact that the opening of discharge nozzles 2 may be carried out in adjustable time intervals by increasing the hydrostatic pressure which acts on the elastically yielding bodies 15, causing a simultaneous opening of all nozzles 2 at the same time.

The boosting period is extremely short and in the following phase the elastically yielding bodies 15 are influenced only by operational hydrostatic pressure to which the regulating system is adjusted. For this reason, as soon as the thickened fraction is discharged, the radial level *d* (having now a higher density) drops and consequently the elastically yielding body 15 extends outwardly and the nozzles 2 are closed. This closing of all nozzles 2 is not simultaneous. The nozzles close independently according to the radial lowering of the level *d* of the thickened fraction up to the point where the elastically yielding body 15 emerges.

I claim:

1. A method for automatically discharging a thickened fraction of a suspension from a centrifuge rotor by discharge nozzles in dependence on the level of the thickened fraction, wherein the opening and closing of discharge nozzles is derived from changes of the shape of an elastically yielding body situated at a desired level of said fraction, comprising the steps of applying to the front wall of the elastically yielding body facing the rotor axis a constant pressure independent of the hydrostatic pressure of the suspension and of the thickened fraction respectively, and maintaining the rate of flow of said suspension into said rotor whereby the pressure of the suspension and of the thickened fraction in the rotor is periodically increased by increasing the level of the suspension in the rotor.

2. The method as claimed in claim 1, wherein the periodical increase of the level of the suspension in the rotor is accomplished by a periodical pressure increase in the discharge path of the cleared fraction.

3. An arrangement for automatically discharging a thickened fraction of a suspension from a centrifuge rotor through discharge nozzles, comprising a centrifuge rotor with a number of discharge nozzles around its circumference, a number of separator discs fixed in the rotor, means for supplying said suspension to the rotor, means for discharge of the cleared fraction from the rotor, each of said discharge nozzles for the thickened fraction being provided with a radial valve rod for opening and closing the nozzle at the end thereof facing the circumference of the rotor, a disc shaped hollow regulating body fixed in the central part of the rotor, said regulating body extending into a number of chambers opposite to each of said discharge nozzles, with channels connecting said chambers with the interior of the hollow regulating body, elastically yielding bodies communicating with respective ones of said chambers and connected to respective valve rods, the valve rods passing through said elastically yielding bodies, strap plates fixed on the ends of said valve rods, facing the rotor axis, for securing the valve rods to said elastically yielding bodies, elastic collars forming walls of chambers of the regulating body and coupled to ends of the elastically yielding bodies, facing the rotor axis, the interior of the regulating body with said chambers and connecting channels being partially filled with a liquid, and means for intermittently increasing the throughflow resistance in the discharge path of the cleared fraction.

4. The arrangement as claimed in claim 3, wherein diaphragms form part of the side walls of the regulating body.

5. The arrangement as claimed in claim 3, comprising a source of control pulses for the control of said means for increasing the throughflow resistance in the discharge of the cleared fraction.

* * * * *

UNITED STATES PATENT OFFICE
CERTIFICATE OF CORRECTION

Patent No. 4,078,718 Dated March 14, 1978

Inventor(s) Jan Putterlik

It is certified that error appears in the above-identified patent and that said Letters Patent are hereby corrected as shown below:

FIG. 2 of the drawings should be deleted to appear as shown on the attached sheet.

Column 1, line 29: Cancel "This arrangement".

line 40: "lenghtening" should be --lengthening--.

line 56: ", if, however" should be -- . If, however--.

line 66: "are" should be --is--.

Column 3, line 33: "Radial" should begin a new paragraph.

line 34: "vanes (See FIG. 2) 9" should be --vanes 9 (See FIG. 2)--.

Column 4, line 54: "Therefore" should begin a new paragraph; after "if" insert --after sufficient--.

UNITED STATES PATENT OFFICE

CERTIFICATE OF CORRECTION

Patent No. 4,078,718 Dated March 14, 1978

Inventor(s) Jan Putterlik

It is certified that error appears in the above-identified patent and that said Letters Patent are hereby corrected as shown below:

Column 4, line 64: "The periodic" should begin a new paragraph.

Signed and Sealed this

*First* Day of *January 1980*

[SEAL]

*Attest:*

SIDNEY A. DIAMOND

*Attesting Officer*

*Commissioner of Patents and Trademarks*